US006749005B1

(12) United States Patent
Stummer et al.

(10) Patent No.: US 6,749,005 B1
(45) Date of Patent: Jun. 15, 2004

(54) SEALING OF SUCTION CASING ON THE PISTON SIDE DURING A VACUUM DIE-CASTING METHOD

(75) Inventors: Friedrich Stummer, Fellbach (DE); Tobias Schwarz, Esslingen (DE)

(73) Assignee: Mueller Weingarten AG, Weingarten (DE)

( * ) Notice: Subject to any disclaimer, the term of this patent is extended or adjusted under 35 U.S.C. 154(b) by 0 days.

(21) Appl. No.: 09/959,147

(22) PCT Filed: Mar. 10, 2000

(86) PCT No.: PCT/DE00/00764

§ 371 (c)(1),
(2), (4) Date: Oct. 18, 2001

(87) PCT Pub. No.: WO00/67935

PCT Pub. Date: Nov. 16, 2000

(30) Foreign Application Priority Data

May 8, 1999 (DE) ..... 199 21 496

(51) Int. Cl.[7] ..... B22D 17/14
(52) U.S. Cl. ..... 164/312
(58) Field of Search ..... 164/312, 113, 164/253, 254, 256, 257, 61, 63, 65, 66.1

(56) References Cited

U.S. PATENT DOCUMENTS 3,009,218 A 11/1961 Rearwin
3,254,377 A * 6/1966 Morton ..... 164/149
4,476,911 A * 10/1984 Lossack et al. ..... 164/65
4,660,614 A * 4/1987 Spriestersbach et al. .... 164/113
4,886,107 A * 12/1989 Zecman ..... 164/113
5,076,344 A * 12/1991 Fields et al. ..... 164/457
5,201,358 A * 4/1993 Stummer et al. ..... 164/312
6,237,672 B1 5/2001 Perrella et al.

FOREIGN PATENT DOCUMENTS

DE 3041340 C2 5/1982
DE 197 54 532 4/1999
EP 0 462 218 12/1991

* cited by examiner

*Primary Examiner*—Kiley Stoner
*Assistant Examiner*—Kevin P. Kerns
(74) *Attorney, Agent, or Firm*—Venable LLP; Robert Kinberg; Chad C. Anderson

(57) ABSTRACT

For the use of the vacuum die-casting process, it is an essential precondition that the casting process takes place in a circuit sealed off on the outside, so that the undesirable ingress of air is avoided, corresponding safe sealing systems are necessary. The sealing between a casting piston and a suction box is designed in such a way that a long service life of the seal is ensured and a possible risk of accidents is avoided.

4 Claims, 2 Drawing Sheets

SEALING OF SUCTION CASING ON THE PISTON SIDE DURING A VACUUM DIE-CASTING METHOD

BACKGROUND OF THE INVENTION

1. Field of the Invention

The invention relates to piston-side sealing in die-casting machines which work according to a vacuum process, in particular according to the VACURAL process, and are provided with a suction gap or suction box. ("VACURAL" is a German trademark of Maschinenfabrik Müller-Weingarten AG of Weingarten, Germany. Reference is made to U.S. Pat. No. 4,476,911, describing the VACURAL process.)

To increase the functional safety and the service life of the seal, sealing on a casting piston stepped in diameter is proposed.

2. Related Art

The production of light-metal parts is carried out in considerable quantities by the die-casting process. In this case, components made of aluminum and its alloys occupy a predominant position, but magnesium is becoming increasingly more attractive as a design material.

The known die-casting processes traditionally carried out are the cold-chamber process or, particularly for smaller components, the hot-chamber process. These processes have proved successful for a wide variety of parts. However, if high-grade components having minimum oxide and impurity inclusions are required, these components ensuring higher dynamic strength values and/or being subjected to a subsequent heat treatment, a vacuum die-casting process is preferably used.

In one of these processes, the metering of the melt into the filling chamber is effected via a seuction pipe located in the melting bath. This metering of the melt is brought about by the application of a vacuum, which is switched on by opening a vacuum valve after the mold is closed. In addition to this mold vacuum, an additional casting-chamber vacuum is also possible for a better and more controlled vacuum effect, as described by the applicant in DE 30 41 340 C2 as VACURAL die-casting process.

To achieve corresponding process safety and ensure an optimum vacuum effect, the entire process must as far as possible take place in a closed circuit and thus be appropriately sealed off to the outside.

In this case, a region to be sealed off is the rear side of the piston or of the piston rod which is coupled to the casting unit. The suction box which discharges the thin light-metal residues, the "spangle", escaping on the rear side of the casting piston has proved successful as a seal carrier.

Thus, for example, in EP 0 462 218, a seal which seals off the casting-piston rod in the outlet region from the suction box is provided in a flanged bush fastened to the end of the suction box. A considerable disadvantage of this seal arrangement is that, in the event of the piston breaking off at the connecting thread between piston and piston rod, the sealing effect at the piston rod is retained. Normally, the cooling-water holes required for the piston cooling are located in the piston rod, so that, after the piston breaks off, the cooling water escapes from the casting-piston rod. Due to the situation which then results, the cooling water can then run back essentially only via the suction pipe into the melting bath of the holding furnace. In addition to the disturbance of the casting process and the impairment of the melt, there is then a high accident risk when casting magnesium or aluminum. Possible risks arise due to an explosive-like reaction or due to the considerable increase in volume and thus the considerable increase in pressure of the cooling water, meeting the hot melt in the suction pipe, in the resulting closed-off space. A further disadvantage of this seal arrangement is the increased seal wear if the piston and piston rod are not symmetrical to one another, i.e. if they are offset.

Sealing on a casting piston has been disclosed by U.S. Pat. No. 3,009,218; a casting piston having a uniform piston diameter over its entire length is proposed. Due to the casting process, damage, such as scouring or scores, occurs in the casting chamber, and this mechanical impairment also leads to damage to the casting piston. In the design proposed, the piston seal may then likewise be damaged and the sealing effect is not ensured in continuous operation.

SUMMARY OF THE INVENTION

The object of the invention is to develop a sealing system for a casting piston for the use of the vacuum die-casting process, which sealing system ensures a long service life and substantially reduces a risk of accidents.

According to the invention, the object is achieved in that an extended casting piston has at least one step, i.e. a smaller diameter, at its rear end, and the seal attached in the suction box is in sealing connection with the piston when the latter is being retracted. In this case, the seal is to be fitted via a frictional or positive-locking connection, and the sealing ring may have a dividing point which permits its fitting or exchange without substantial assembly measures. The casting-piston design selected, on the one hand, ensures that mechanical piston damage does not occur on the smaller seal diameter, since this diameter has no contact with the bore of the casting chamber, and, on the other hand, the casting-piston diameters are concentric due to the simple manufacturing process. Furthermore, after a piston rod breaks off, which as a rule would be effected in the region of an advanced casting position, the cooling water could escape through the annular space which is now open to the rear.

Further details and advantages of the invention follow from the description below of an exemplary embodiment.

The present invention will be described with reference to the accompanying figures, where:

DETAILED DESCRIPTION OF THE PREFERRED EMBODIMENTS

Figure 1:
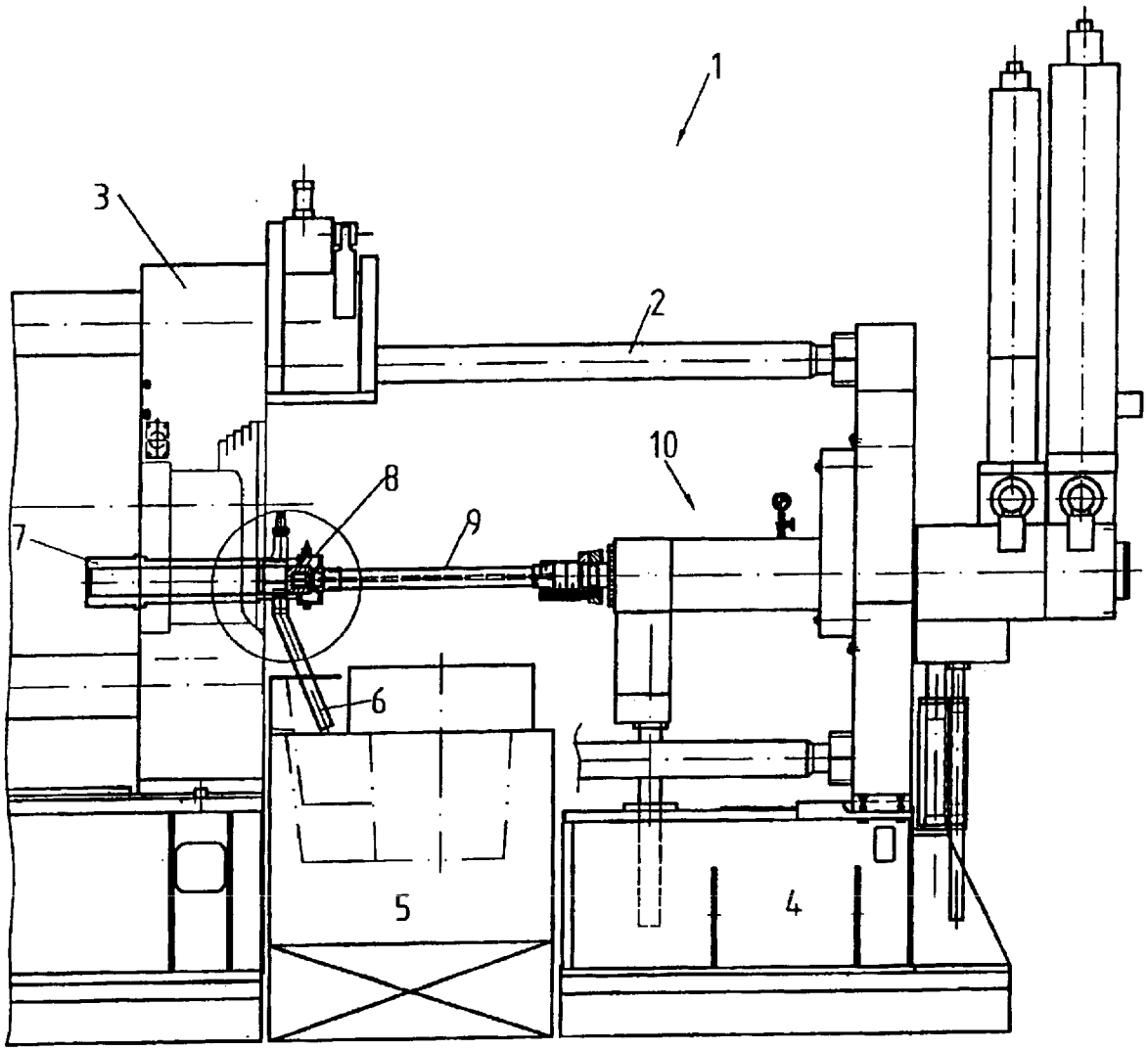
FIG. 1 shows an injection system of a VACURAL die-casting machine.

FIG. 1 shows the injection system 1 of a VACURAL die-casting machine, this injection system 1 being connected to the fixed mounting plate 3 via an anchor 2. The holding furnace 5 for the liquid melt is arranged between the fixed mounting plate 3 and the column part 4 of the injection system 1. The suction pipe plunging below the melting bath surface into the holding furnace 5 is designated by 6. The top end of the suction pipe 6 is connected to the casting chamber 7. Located in the casting chamber 7 is the casting piston 8, which is connected to the casting-piston rod 9. The casting-piston rod 9 is connected to the actual casting unit 10.

Figure 2:
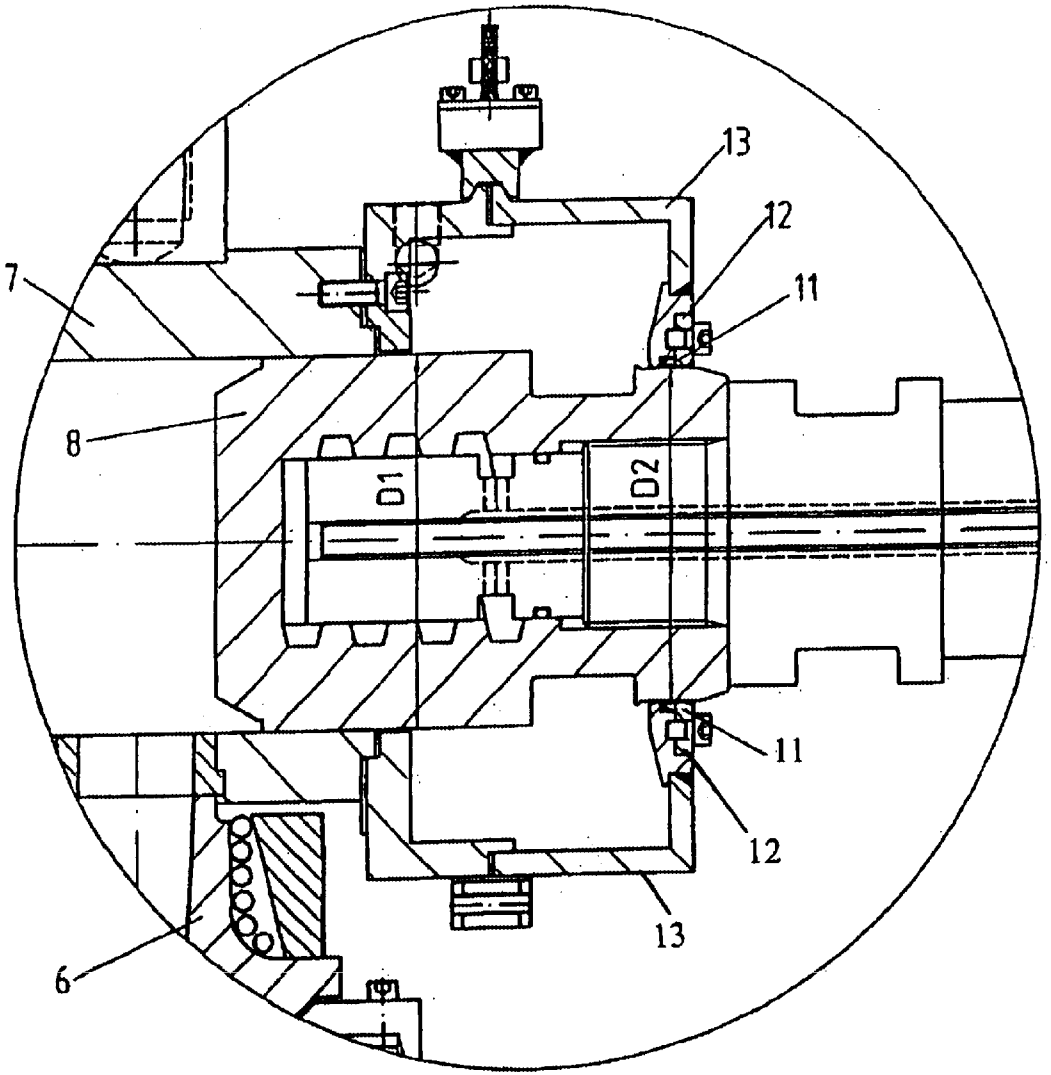
FIG. 2 shows a detail of the casting piston with suction box and sealing.

An enlarged representation of an exemplary embodiment of the invention is shown in FIG. 2. Located in the casting chamber 7 is the casting piston 8, which has diameters D1 and D2 of different sizes. The smaller diameter D2 is sealed off by the seal 11 in the retracted position shown, the retracted position corresponding to the operating state in which the melt is sucked in through the suction pipe 6 by the build up of vacuum, whereas sealing is no longer necessary in the forward movement of the casting piston 8. The situation may even occur in which an afterflow of air or the specific use of an inert gas necessitates the lowering of the residual melt and thus the prevention of "freezing" of the melt in the suction pipe. The seal 11 is frictionally connected to the suction box 13 by means of a clamping ring 12. By appropriate shaping of the sealing ring 11, e.g. a T-profile, a positive-locking connection may also be selected. A sealing ring 11 divided on one side or both sides is preferably used, which permit an exchange of the sealing ring only by removing the clamping or retaining ring 12. The separable region of the sealing ring may be designed, for example, in the form of an inclined joint, as a result of which an optimum sealing effect is achieved. The casting piston 8 is preferably designed in such a way that the smaller diameter D2 (=sealing diameter) is designed so as to be conically tapered in its end region and the transitions are formed with diameters appropriate to safely seal the casting piston and the suction box. This form ensures movement into and out of the seal 11 in a functionally safe manner, which in turn helps to preserve the seal.

The invention is not restricted to the exemplary embodiment described and shown. It also comprises all developments by the person skilled in the art within the scope of the appended claims.

What is claimed is:

1. A sealing arrangement for a die-casting machine comprising:

a casting chamber;

a melting or holding furnace for holding melted metal;

a suction pipe for effecting transport of metal from the melting or holding furnace into the casting chamber;

a casting piston connected to a piston rod at a connecting thread for insertion into the casting chamber, wherein the casting piston has at least two portions with different diameters D1 and D2, wherein D1 is greater than D2, the smaller diameter D2 being the diameter of a rear end of the casting piston;

a suction box disposed about the casting piston adjacent said casting chamber and removed from said suction pipe, said suction box adapted to remove metal residues from the casting piston portion with the greater diameter D1; and a seal having an opening with a diameter substantially equal to said smaller diameter D2 and being arranged between the casting piston and the suction box to form a seal between the casting piston and the suction box, wherein the seal is in front of the piston rod when the casting piston is in a retracted position, and wherein the seal is not in communication with the casting piston portion with the greater diameter D1.

2. The sealing arrangement as claimed in claim 1, further comprising a clamping or retaining ring for connecting the seal to the suction box in a frictional or positive-locking manner.

3. The sealing arrangement as claimed in claim 2, wherein the seal has at least one separable portion.

4. The sealing arrangement as claimed in claim 1, wherein the rear end of the casting piston is formed with a conical end having the smaller diameter D2.

* * * * *